US005193373A

United States Patent [19]

Hunt

[11] Patent Number: 5,193,373

[45] Date of Patent: Mar. 16, 1993

[54] SECURITY DEVICE FOR DEADBOLT LOCK

[76] Inventor: Robert J. Hunt, 5009 Green Mountain Cir., Columbia, Md. 21044

[21] Appl. No.: 851,500

[22] Filed: Mar. 16, 1992

[51] Int. Cl.[5] ..... E05B 13/08

[52] U.S. Cl. ..... 70/416; 70/210; 292/DIG. 2

[58] Field of Search ..... 70/416, 210, 211, 57, 70/14, 429, 430; 292/288, 289, 258, DIG. 2

[56] References Cited

U.S. PATENT DOCUMENTS

| | | | |
|---|---|---|---|
| 1,887,951 | 11/1932 | Crum | 70/430 |
| 2,461,676 | 2/1949 | Budak | 70/416 |
| 3,263,462 | 8/1966 | Suroff et al. | 70/211 |
| 3,585,827 | 6/1971 | Dominguez | 70/416 |
| 3,724,246 | 4/1973 | Katsaros | 70/211 |
| 4,127,967 | 12/1978 | Franzl | 70/416 |
| 4,715,200 | 12/1987 | Katsaros | 70/416 |
| 4,827,745 | 5/1989 | Baugh | 70/416 |
| 5,099,663 | 3/1992 | Dearstine | 70/78 |

FOREIGN PATENT DOCUMENTS

| | | | |
|---|---|---|---|
| 14476 | of 1896 | United Kingdom | 70/430 |
| 351049 | 6/1931 | United Kingdom | 70/416 |

*Primary Examiner*—Renee S. Luebke
*Assistant Examiner*—D. Boucher
*Attorney, Agent, or Firm*—Roy W. Butrum

[57] ABSTRACT

A security device to be usable with a dead bolt lock to prevent the lock from being opened from the outer side of an associated door. The security device includes a body member having a space for receiving a dead bolt lock handle and a slidable retainer for locking the handle to the body member with a pin. The pin is attached to one end of a flexible connector with the other end being affixed to an attachment plate mounted on the door. The flexible connector and attachment plate prevent the body member and handle from rotating due to unauthorized turning of the dead bolt.

14 Claims, 2 Drawing Sheets

SECURITY DEVICE FOR DEADBOLT LOCK

BACKGROUND OF THE INVENTION

The invention relates to a security device which prevents a deadbolt lock from being opened from the outer side of an associated door.

It is necessary to lock certain doors such as outside doors in a house or entry doors to an apartment or hotel room. These doors are provided with a conventional doorknob including a locking mechanism which is adapted to be operated by a key from the outer side of the door.

In order to provide greater security, a deadbolt lock is often also mounted on the door and includes a bolt having flat sides which is movable into and out of a complementary receptacle in an associated door jamb. The deadbolt lock is operated by a key from the outer side of the door, and is operated by a handle from the inner side of the door. This handle is spaced from the inner side of the door and is pivoted through a substantial angle in moving between between locked and unlocked positions. The deadbolt lock can be operated form the inner side of the door by grasping and turning the handle, while the deadbolt lock can be operated from the outer side of the door only by turning a key.

When a deadbolt lock is opened by a key, the handle also pivots through a predetermined angle. If pivoting movement of the handle from its locked position to its unlocked position is prevented, the deadbolt lock cannot be opened from the outer side of the door.

Lock picking tools have been developed which enable unauthorized persons to open deadbolt locks. Furthermore, particularly in connection with apartments, dormitories and hotel rooms, unauthorized persons may come into possession of a key to a deadbolt lock, and accordingly, the deadbolt lock does not actually provide the desired security.

Accordingly, there is a need to provide a security device which can be attached to a deadbolt lock handle at the inner side of a door which positively prevents the deadbolt lock from being opened from the outer side of the door either by a key or a lock picking tool. A number of prior art devices have been developed to accomplish this purpose as shown for example in U.S. Pat. Nos. 4,279,137, 4,715,200, 4,827,745 and 5,000,498.

These prior art devices have certain disadvantages which have limited their success and acceptance by the public. Some of the prior art devices are limited to use with handles of a certain size or configuration, while others are excessively difficult and time consuming to place in operative locking position or to release when it is desired to unlock the deadbolt lock. Difficulty in releasing the device would be particularly hazardous if a person needed to open the door quickly in the event of a fire. A further problem with these prior art devices is that they are not always readily available since they must be stored somewhere other than on the inner side of the door.

OF THE INVENTION

The invention includes a body means having a space for receiving the deadbolt lock handle, and a retaining means is movably supported on the body means for movement relative to the body means between a release position for releasing the device from the handle and a retaining position for retaining the device in mounted operative position on the handle. This arrangement enables the device to be effectively mounted on handles of different size and configuration.

A stop means is provided for engaging the retaining means and limiting movement of the retaining means in a direction which permits the handle to be released from the body means. In order to mount the body means in operative position on the handle, the retaining means is moved in a first direction relative to the body means and the stop means is readily placed in position. In order to release the body means from the handle, the stop means is removed and the retaining means moved in a second direction relative to the body means. The body means is then moved away from the handle. In this manner, the device may be quickly and easily moved into operative locking position or released from the handle when so desired.

An anchor means is attached to the inner side of the door, and flexible connecting means is connected between the anchor means and the body means to prevent the body means and handle from being pivoted into unlocked position. This anchor means is also provided with support means for supporting the body means on the inner side of the door so that the security device is available at all times.

DESCRIPTION OF THE PREFERRED EMBODIMENTS

Figure 1:
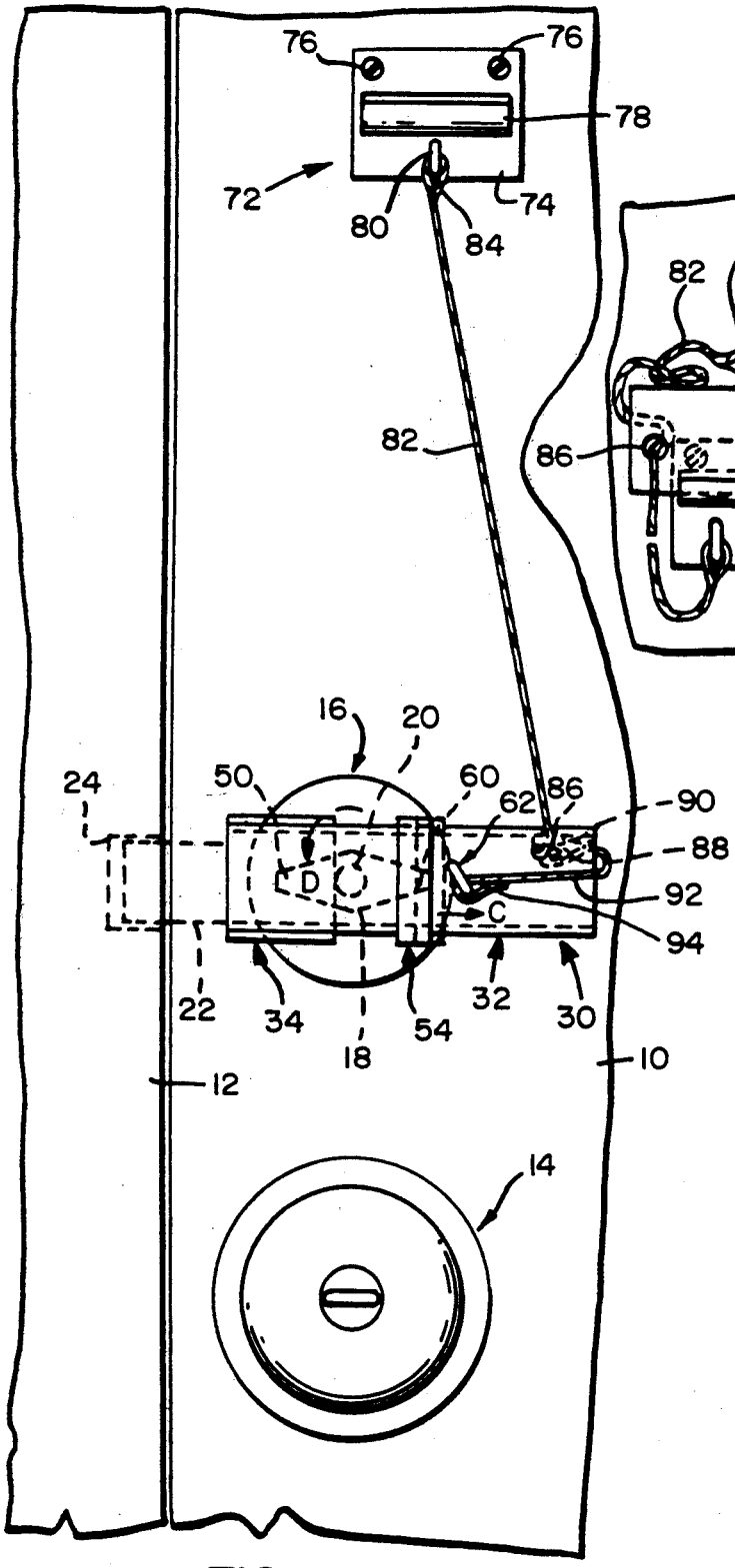
FIG. 1 is an elevation, partly broken away, illustrating the device mounted in operative position on a door.

Referring now to the drawings wherein like reference characters designate corresponding parts throughout the several views, there is shown in FIG. 1 the inner side of a typical door 10 the edge of which is disposed adjacent to the edge of a door jamb 12. The door is provided with the usual doorknob assembly 14, and in addition, a deadbolt lock is indicated by arrow 16. The deadbolt lock is of conventional construction and includes an inner handle 18 connected to a shaft 20 extending into the deadbolt mechanism within the door so that pivotal movement of the handle about the centerline of the shaft causes the deadbolt lock to be locked and unlocked. The deadbolt lock includes a bolt portion 22 which is adapted to be received within a complementary receptacle 24 supported within the door jamb.

Figure 4:
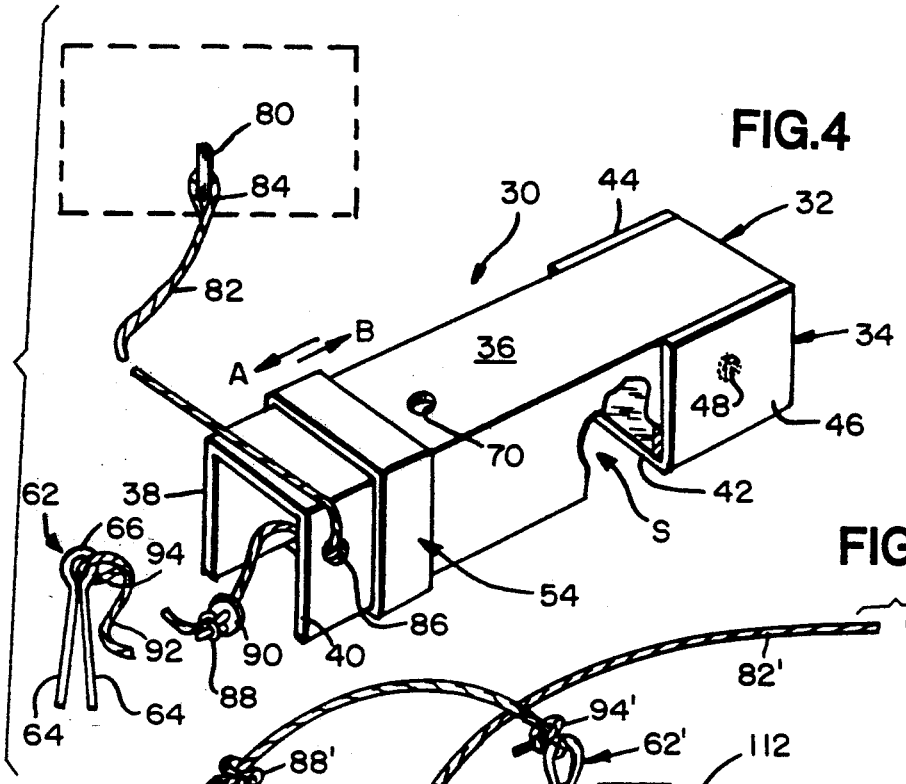
FIG. 4 is a top perspective view of the device, partly broken away.
Figure 5:
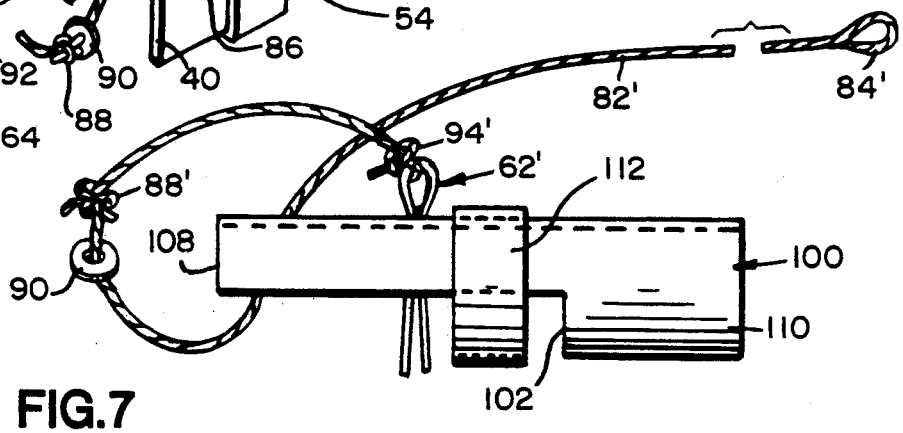
FIG. 5 is an elevation of a modified form of the device of the invention.
Figure 7:
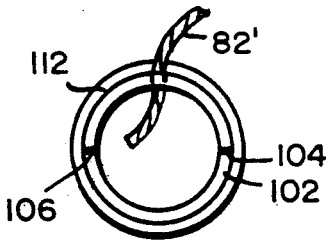
FIG. 7 is an end view of the device shown in FIG. 6.
Figure 6:
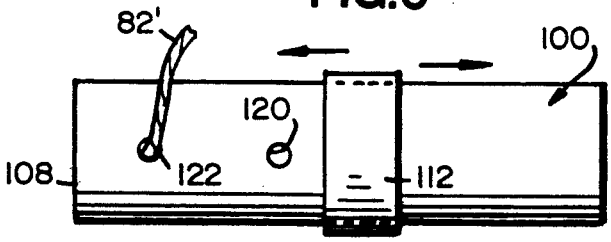
FIG. 6 is a top view of the device shown in FIG. 5.
Figure 9:
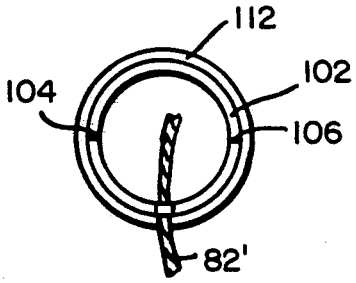
FIG. 9 is an end view of the device shown in FIG. 8.
Figure 8:
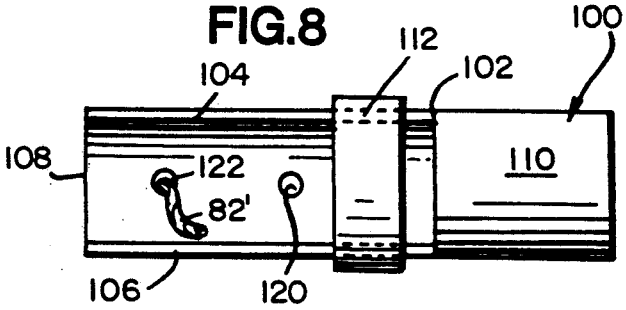
FIG. 8 is a bottom view of the device shown in FIG. 5.

As seen in FIG. 4, a first form of the the security device according to the invention is illustrated. The device includes a body means generally indicated by reference numeral 30 which defines a space S therewithin for receiving the handle when the device is mounted in operative position on an associated handle.

The body means includes a first elongated channel member 32 of generally U-shaped cross-sectional configuration comprising a base portion 36 joined with a pair of parallel flange portions 38 and 40. The body means includes a second channel member 34 of generally U-shaped cross-sectional configuration which is of substantially less length than member 32. Channel member 34 includes a base potion 42 joined with a pair of parallel flange portions 44 and 46. The channel members 32 and 34 are disposed in facing nested relationship and are secured to one another by spot welds such as 48 at each of the flange portions 44 and 46.

The outer free edges of flange portions 38 and 40 define a slot along one side of the body means which is in communication with the space within the body means. The handle of the deadbolt lock is inserted through this slot and then the body means is moved relative to the handle so that one end 50 of the handle is moved into the portion of the space S disposed within channel member 34 as seen in FIG. 1 so that member 34 serves as a retaining portion to prevent the handle from moving laterally of the body means through the slot defined between the outer edges of the flange portions of channel member 32.

A retaining means 54 comprises a band of generally rectangular cross-section which surrounds the channel member 32 and has an interior configuration which is complementary to that of member 32 so that the band may slide along member 32 in opposite directions as indicated by the arrows A, B as seen in FIG. 4. Movement in the direction of arrow B is limited by engagement of band 54 with channel member 34. It is noted that the channel members as well as the band are formed of strong rigid material such as metal to resist deformation when in use. Other rigid materials such as plastic may be employed if so desired.

After the body means has been moved into the operative position shown in FIG. 1 relative to the handle of a deadbolt lock, the band 54 is moved into the full line position as shown in FIG. 1 so as to overlie the end 60 of the handle, thereby cooperating with the channel member 34 to prevent the handle from escaping from the body means through the slot thereof when the device is in operative position on the handle.

In order to restrict movement of the band 54 in the direction of the arrow C in FIG. 1, a stop means in the form of a pin 62 is provided. This pin as seen in FIG. 4 includes a pair of legs 64 joined by a resilient bight portion 66 so that the legs are normally urged away from one another. This pin is inserted through a hole 70 formed in base portion 36 of channel member 32 by squeezing the outer ends of the legs of the pin together. After the pin is in place, the pin will be retained in place since the legs are normally urged away from one another.

Referring again to FIG. 1, after band 54 is moved into the position shown in full lines, pin 62 is inserted through hole 70. The band can then move into the phantom line position where it engages the pin to limit movement of the band in the direction of arrow C. In this manner, the device is positively retained in position on the handle during use. When it is desired to remove the device from the handle, the pin is removed and the band is moved in the direction of arrow C relative to the body means. The body means is then moved to the left as seen in FIG. 1 relative to the handle, and the handle can then move outwardly of the body means through the slot thereof, and the body means can be completely removed from the handle.

An anchor means 72 includes a plate 74 preferably formed of metal or other rigid material which is connected to the inner side of the door by a pair of screws 76 passing through suitable holes in the plate and being threaded into the material of the door. In some instances, it may not be desirable to form holes in the door such as when the device is used with a door in a rented apartment, and in such a case, the plate 74 may be secured to the inner side of the door by a suitable adhesive substance. A support means 78 in the form of a clip of generally U-shaped cross-sectional configuration is provided to support the body means when not in use as hereinafter explained, and an eyelet 80 formed of metal is fixedly secured as by welding to the plate.

An elongated flexible connecting means 82 is connected between the anchor means and the body means for preventing the handle from being moved from a locked position as shown in FIG. 1 to an unlocked position. This connecting means may take various forms such as a strong piece of string formed of nylon or the like, a chain or a piece of wire. A string is illustrated and includes an upper end which includes a loop 84 which is attached to eyelet 80. The string extends through a hole 86 formed in flange 40 of channel member 32 and has a knot 88 formed at a suitable point therealong. A disc shaped grommet 90 is of greater diameter than the hole 86 and has a central opening through which the string extends. The grommet is mounted on the string such that the knot engages the grommet and cannot be pulled through the hole 86 because of the grommet. The string also includes a further portion 92 having an outer end connected to the bight portion of pin 62 by a loop 94 so that the pin is not misplaced.

Figure 2:
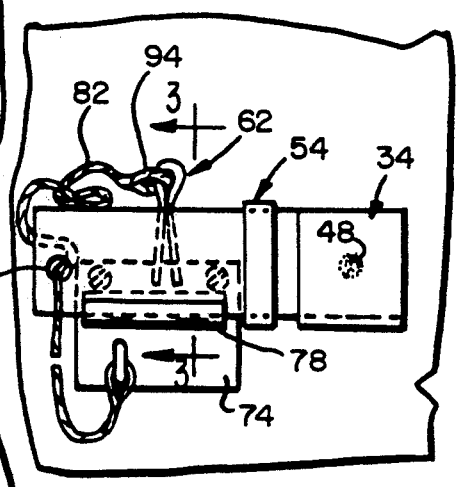
FIG. 2 is an elevation on an enlarged scale illustrating the manner in which, the device is supported in stored position.
Figure 3:
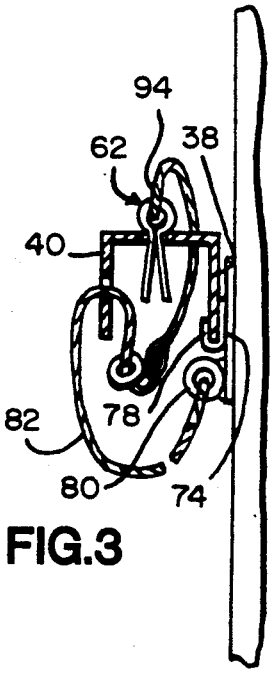
FIG. 3 is a sectional view taken substantially along line 3—3 of FIG. 2 looking in the direction of the arrows.

When not in operative locking position on the deadbolt lock handle, the body means as well as the string and pin attached thereto are stored in the position shown in FIGS. 2 and 3 wherein the flange 38 is disposed in the clip 78. With this arrangement, the device is conveniently supported in stored position on the inner side of the door for use at all times. It should be understood that portion 92 of the string can be eliminated, and the pin may be stored in position within the hole 70 when the device is in the position shown in FIGS. 2 and 3.

The manner of use of the device will now be described. As seen in FIG. 1, the handle has been pivoted in the direction of the arrow D from a generally vertical position to the horizontal position shown to move the bolt 22 into the receptacle 24 to lock the deadbolt lock. The device is then mounted on the handle in the manner previously described and the pin 62 inserted in position within hole 70 to prevent the handle from escaping from the body means. The locked position of the device is shown in FIG. 1, the length of the string 82 from the knot to the anchor means being selected so that in the position shown, there is little or no slack in this length of the string.

If a person should now attempt to open the door from the outer side thereof, the handle would tend to swing through an angle in a direction opposite to that of arrow D. Such movement tends to move the end 60 of the handle in a downward direction carrying with with it the body means 30. Accordingly, the right hand end of the body means as seen in FIG. 1 will tend to move downwardly in an arc about the center of shaft 20 of the handle. Such movement of the body means is resisted by string 82 with the knot 88 of the string engaging grommet 90. Accordingly, the body means cannot move downwardly so that the handle can be moved to the unlocked position. The device therefore positively prevents the deadbolt from being unlocked when it is in operative position as shown in FIG. 1.

Referring now to FIGS. 5–9 of the drawings, a modified form of the invention is illustrated. In this form of the invention, the anchor means and the flexible connecting means and the stop pin are identical with those shown in FIGS. 1–4, and accordingly, similar parts have been given the same reference characters primed.

This modification employs a body means which can be manufactured in an efficient and inexpensive manner. A cylindrical body means 100 is formed from a length of metal tubing and has a cutout portion 102 extending through about one-half of the circumference of the cylindrical body means to form edges 104 and 106 of the cutout. The cutout portion extends from one end 108 of the body means through a major portion of the length of the body means and terminates short of the opposite end of the body means to define a retaining portion 110 which is formed by that portion of the body means which extends through 360 degrees of the tubular body means.

A retaining means comprises a band 112 cut from a metal tube the inner diameter of which is complementary to the outer diameter of the body means so that the band can slide axially along the body means. The body means is provided with a first hole 120 for receiving a stop pin and a second hole 122 for receiving the string in the same manner as in the previously described embodiment. The operation of the device shown in FIGS. 5–9 is identical to that shown in FIGS. 1–4, the only difference being in the specific construction of the body means and retaining means in the two embodiments.

The invention has been described with reference to preferred embodiments. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. A security device for preventing unlocking of a deadbolt lock of a door including in combination, a door having inner and outer sides, a deadbolt lock supported on said door and having a handle spaced from the inner side of the door, said handle being movable between an unlocked position and a locked position, said security device comprising a body mounted in operative position on the handle, movable retaining means supported on said body for movement relative to the body between a release position for releasing the device from the handle and a retaining position for retaining the device in mounted operative position on the handle, means for maintaining said retaining means in said retaining position, anchor means attached to the inner side of said door, and flexible connecting means connected between said anchor means and said body, said anchor means and said connecting means comprising the sole means for preventing movement of said body in an unlocking direction, thereby preventing the handle from being moved from a locked position to an unlocked position.

2. A device as defined in claim 1 wherein said body includes a retaining portion which cooperates with said retaining means for retaining the device in mounted operative position.

3. A device as defined in claim 1 wherein said means for maintaining said retaining in retaining position includes a hole formed through said body means and a pin extending through said hole and being engageable with said movable retaining means.

4. A device as defined in claim 1 wherein said movable retaining means is disposed in surrounding relationship to said body.

5. A device as defined in claim 1 including support means for supporting said body on the inner side of said door.

6. A security device for preventing unlocking of a deadbolt lock of a door including in combination, a door having inner and outer sides, a deadbolt lock supported on said door and having a handle spaced from the inner side of the door, said handle being movable between an unlocked position and a locked position, said security device comprising a body defining a space for receiving said handle when the device is mounted in operative position on the handle, said body having an end portion, slidable retaining means slidably supported on said body for movement in a first direction to a retaining position for retaining the device in mounted operative position and for movement in a second direction to a release position for releasing the device from said handle, stop means for engaging said retaining means and limiting movement of said retaining means in said second direction, anchor means fixed to the inner side of said door, and elongated flexible connecting means connected between said anchor means and said body, said anchor means and said connecting means comprising the sole means for preventing movement of said body in an unlocking direction, thereby preventing the handle from being moved from a locked position to an unlocked position.

7. A device as defined in claim 6 wherein said body has a slot along one side thereof in communication with said space for receiving said handle.

8. A device as defined in claim 6 wherein said body has a retaining portion secured to said end portion thereof which cooperates with said slidable retaining means for retaining the device in mounted operative position.

9. A device as defined in claim 6 wherein said slidable retaining means comprises a band surrounding said body.

10. A device as defined in claim 6 wherein said stop means includes a hole formed through said body and a pin extending through said hole and being engageable with said slidable retaining means.

11. A device as defined in claim 6 wherein said connecting is connected to said body means by a connection including a hole formed in said body, said connecting means extending through said hole, a knot formed in said connecting means, and a grommet disposed between said knot and said hole.

12. A device as defined in claim 6 including support means mounted on said anchor means for supporting said body on the inner side of said door.

13. A security device for preventing unlocking of a deadbolt lock of a door including in combination, a door having inner and outer sides, a deadbolt lock supported on said door and having a handle spaced from the inner side of the door, said handle being movable between an unlocked position and a locked position, said security device comprising a body including a first elongated channel member of generally U-shaped cross-sectional configuration mounted in operative position on the handle, said first channel member having an end, a retaining portion comprising a second channel member of generally U-shaped cross-sectional configuration fixed to said end of said first channel member and being of substantially less length than said first channel member, said channel members being disposed in facing nested relationship to one another, a slidable retaining means comprising a band of generally rectangular cross-section surrounding said first channel member and being slidable therealong between a retaining position for retaining the device in mounted operative position and a release position for releasing the device from said handle, said body having a hole formed therethrough, a stop pin extending through said hole and being engageable with said band for maintaining the band in retaining position, anchor means attached to the inner side of said door, and flexible connecting means connected between said anchor means and said body means for preventing the handle from being moved from a locked position to an unlocked position.

14. A security device for preventing unlocking of a deadbolt lock of a door including in combination, a door having inner and outer sides, a deadbolt lock supported on said door and having a handle spaced from the inner side of the door, said handle being movable between an unlocked position and a locked position, said security device comprising a cylindrical body mounted in operative position on the handle, said cylindrical body including opposite ends and having a cutout portion extending through about one-half of the circumference of the cylindrical body and from one of said ends throughout a major portion of the length of said cylindrical body and terminating short of the opposite one of said ends to form a retaining portion at said opposite one of said ends, a slidable retaining means comprising a band of generally circular cross-section surrounding said cylindrical body and being slidable therealong between a retaining position for retaining the device in mounted operative position and a release position for releasing the device from said handle, said cylindrical body having a hole formed therethrough, a stop pin extending through said hole and being engageable with said band for maintaining the band in retaining position, anchor means attached to the inner side of said door, and flexible connecting means connected between said anchor means and said body for preventing the handle from being moved from a locked position to an unlocked position.

* * * * *